US008113553B2

(12) United States Patent
Kosunen

(10) Patent No.: US 8,113,553 B2
(45) Date of Patent: Feb. 14, 2012

(54) DIVIDED SPINDLE

(75) Inventor: Heikki Kosunen, Joensuu (FI)

(73) Assignee: Abloy Oy, Helsinki (FI)

( * ) Notice: Subject to any disclaimer, the term of this patent is extended or adjusted under 35 U.S.C. 154(b) by 560 days.

(21) Appl. No.: 12/299,896

(22) PCT Filed: Apr. 19, 2007

(86) PCT No.: PCT/FI2007/050205

§ 371 (c)(1),
(2), (4) Date: Nov. 17, 2008

(87) PCT Pub. No.: WO2007/128868

PCT Pub. Date: Nov. 15, 2007

(65) Prior Publication Data

US 2009/0160202 A1 Jun. 25, 2009

(30) Foreign Application Priority Data

May 9, 2006 (FI) ..... 20065302

(51) Int. Cl.
*E05B 63/16* (2006.01)

(52) U.S. Cl. ..... 292/358; 292/1

(58) Field of Classification Search ..... 292/1, 347, 292/358, 1.5, 350–351
See application file for complete search history.

(56) References Cited

U.S. PATENT DOCUMENTS

| | | | | | |
|---|---|---|---|---|---|
| 797,137 | A | * | 8/1905 | Marion | 70/149 |
| 1,015,765 | A | | 1/1912 | Spring | |
| 1,731,935 | A | * | 10/1929 | Petermann | 292/358 |
| 1,731,953 | A | | 10/1929 | Thomson | |
| 5,364,139 | A | | 11/1994 | Bergen et al. | |

FOREIGN PATENT DOCUMENTS

| | | |
|---|---|---|
| DE | 614908 | 6/1935 |
| DE | 2601759 | 7/1977 |
| EP | 0555633 | 8/1993 |
| GB | 2167528 | 5/1986 |
| TW | 542294 | 7/2003 |
| WO | 2005111347 | 11/2005 |

OTHER PUBLICATIONS

English translation of Taiwanese Search Report for TW 096114379, Jul. 28, 2010.

* cited by examiner

*Primary Examiner* — Kristina Fulton
(74) *Attorney, Agent, or Firm* — Chernoff, Vilhauer McClung & Stenzel

(57) ABSTRACT

This invention relates to lock spindles divided into two parts and interconnected by a connecting pin. The invention particularly relates to solenoid locks. The invention eliminates the effect of an external force applied to a divided spindle on the opposite-side spindle and other parts of the lock. The divided spindle comprises a connecting pin that is round in cross-section, a first spindle and a second spindle. The connecting pin can be connected to the spindle parts so that the spindle parts rotate in relation to the connecting pin.

12 Claims, 2 Drawing Sheets

DIVIDED SPINDLE

This is a national stage application filed under 35 USC 371 based on International Application No. PCT/FI2007/050205 filed Apr. 19, 2007, and claims priority under 35 USC 119 of Finnish Patent Application No. 20065302 filed May 9, 2006.

FIELD OF TECHNOLOGY

This invention relates to lock spindles divided into two parts and interconnected by a connecting pin. The invention also relates to locks with a divided spindle. The invention particularly relates to solenoid lock types and corresponding mechanical lock types.

PRIOR ART

Figure 1:
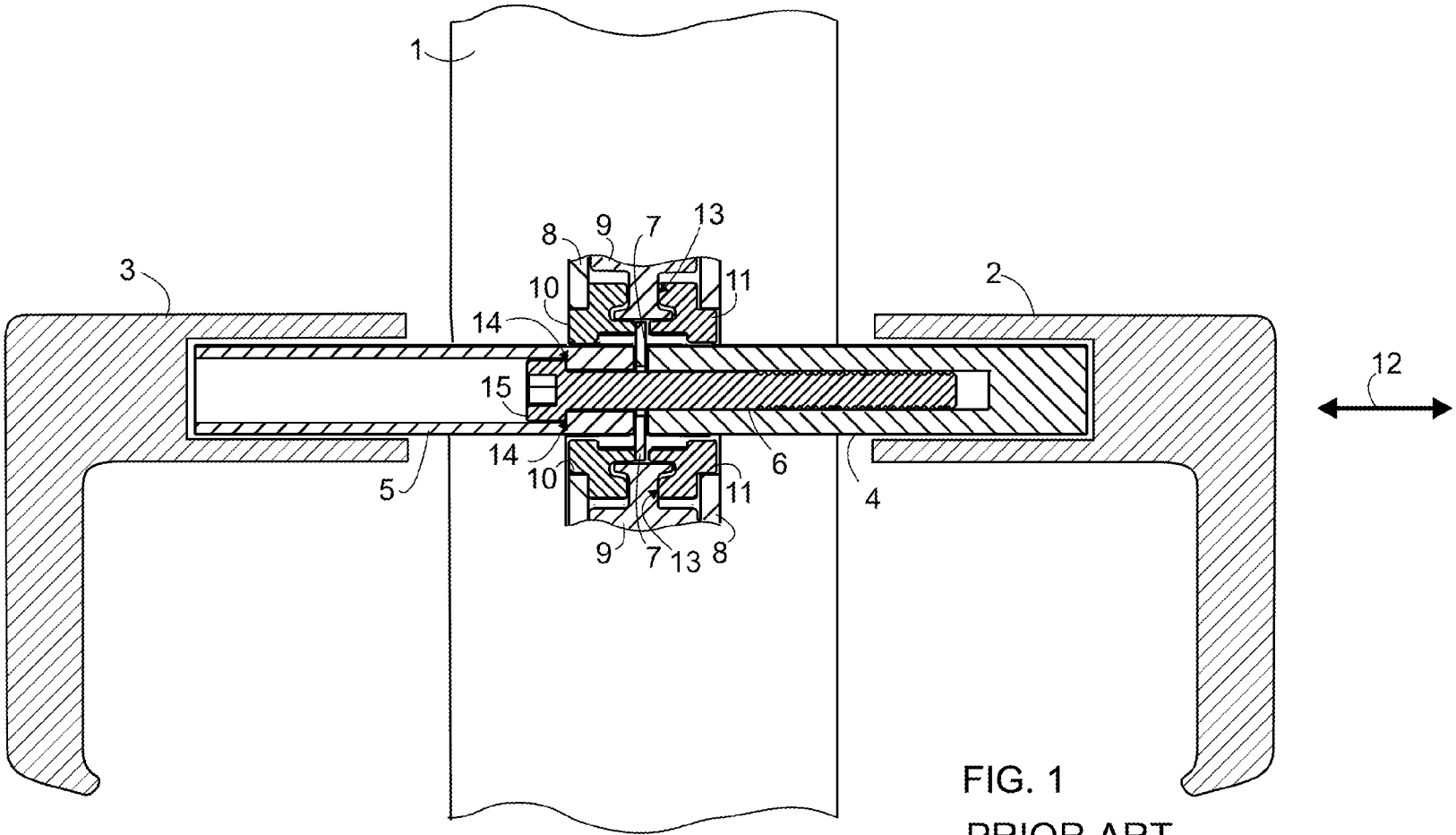
FIG. 1 PRIOR ART

FIG. 1 illustrates a prior art divided spindle composed of two spindle parts 4, 5 and a connecting pin 6 interconnecting these. In the embodiment of FIG. 1, the connecting pin is a one-piece bolt that is screwed into a hole in one of the spindle parts 4 by bolt threads so that the driving end 15 of the bolt 6 remains within an extension of the hole going through the other spindle part 5. The driving end 15 can be turned through the hole in the spindle part 5 by an Allen wrench, for example, depending on the type of tool for which the driving end is machined. The spindle parts 4, 5 of the divided spindle can rotate independently of each other.

A handle of the desired type can be attached to each of the spindle parts. In the example in FIG. 1, the spindle parts 5, 4 are fitted with lever handles 3, 2. The lock cover plates are not shown in FIG. 1. In some embodiments the handles are not attached to the spindle but to the lock cover plates using bearings and a locking ring, for example.

In the embodiment of FIG. 1, a solenoid lock (or a corresponding mechanical type of lock) is fitted to the door 1, and the divided spindle is installed into this. Only the parts of the lock necessary for this description are illustrated. The lock body 8 is fitted with a follower 9 and drivers 10, 11 for both spindle parts 5, 4. When the handle 3 is turned to open the door 1, the spindle part 5 turns, simultaneously turning the driver 10 specific to the spindle part. The driver 10 transfers the torsional force applied to the spindle to the follower 9, which is linked to the lock bolt and opens the lock. Correspondingly, when the handle 2 is turned to open the door 1 from the opposite side of the door, the spindle part 4 turns, simultaneously turning the driver 11 specific to the spindle part. The driver transfers the torsional force to the follower 9.

Furthermore, there is a separate washer 7 between the spindle parts 5 and 4. A separate washer is not required in some embodiments, as the follower 9 is fitted with a sleeve ring that settles into the gap between the spindle parts.

In FIG. 1, the handle 3 and spindle part 5 are inside the door, on the so-called exit side. This means that the door can always be opened using handle 3 as necessary. This example does not account for any deadlocking arrangement. In other words, there is always a link from the spindle part 5 through the driver 10 to the follower 9.

The handle 2 and spindle part 4 are outside the door, on the so-called control side. This means that the transmission of torsional force applied to the handle 2 and spindle part 4 to the follower of the lock can be prevented. In this case, the handle 2 makes a dead turn, and the door can only be opened if the lock is opened by a mechanical key, for example. The transmission of torsional force is prevented on the control side using a solenoid, which results in the door becoming locked.

The problem with the embodiment of FIG. 1 lies in the fact that a locked door can nevertheless be opened from the outside if a sufficient force affecting the spindle is applied to the handle 2 and the spindle part 4, particularly in the longitudinal direction of the spindle, while the handle is turned. The force 12 can be either a pushing force, a pulling force, or a lateral force.

For example, if the handle 2 is pushed with force, the spindle part 4 moves towards the inner side of the door, simultaneously pushing the driver 11 towards the follower 9. Sufficient friction surfaces 13 are formed at the contact surfaces between the follower 9 and the driver 11, which creates a link from the handle 2 to the follower 9. Simultaneous forceful pushing and turning of the handle causes unwanted opening of the lock.

If the handle 2 is pulled with force, a friction surface 14 is formed between the inside spindle part 5 and the driving end 15 of the bolt. Due to the strong pulling force, the friction surface is sufficient to transfer the torque of simultaneous turning force on the handle 2 through the inside spindle part 5 to the driver 10 and the follower 9. Simultaneous strong pulling and turning force on the handle 2 causes unwanted opening of the lock through its inside driver 10.

It is also possible that in certain types of locks and/or handles, a force applied on the spindle that contains a lateral component will result in either of the cases of unwanted opening of the lock described in the above.

The objective of the invention is to eliminate the described problem. The objective will be achieved as presented in the claims.

SHORT DESCRIPTION OF INVENTION

The invention eliminates the effect of an external force applied to a divided spindle on the opposite-side spindle and other parts of the lock. The divided spindle comprises a connecting pin that is round in cross-section, an inside spindle and an outside spindle. The connecting pin is mountable to the spindles so that the spindles rotate in relation to the connecting pin. The attachments between the connecting pin and the spindles are arranged so that a force imposed on the inside or outside spindle in the direction of the spindle shaft and simultaneous turning will not create a sufficient transmission connection to the connecting pin and the opposite shaft.

There are grooves close to the ends of the connecting pin, going around the outer surface of the connecting pin. The spindle parts have bores for the connecting pin and mounting holes for fitting cotter pins. When the connecting pin is in the bore within the spindle part, the cotter pin can be fitted into the transverse groove close to the end of the connecting pin, thus connecting the spindle part and the cotter pin together in a rotating fashion. This prevents the creation of a sufficiently large frictional force caused by pushing or lateral pulling/pushing as sufficient friction will not develop between the cotter pin and the connecting pin due to rotation and the relatively small surface area.

LIST OF FIGURES

Figure 2:
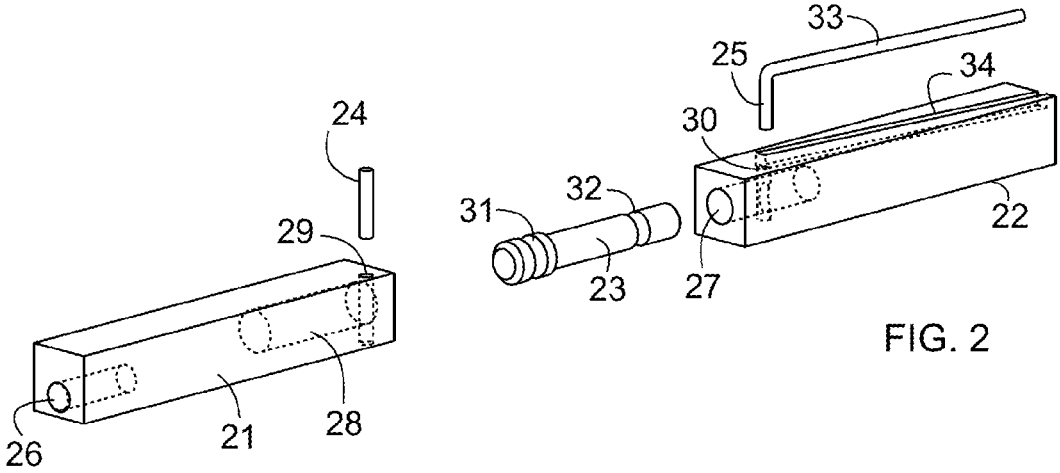
Figure 4:
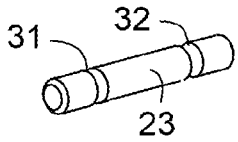
Figure 3:
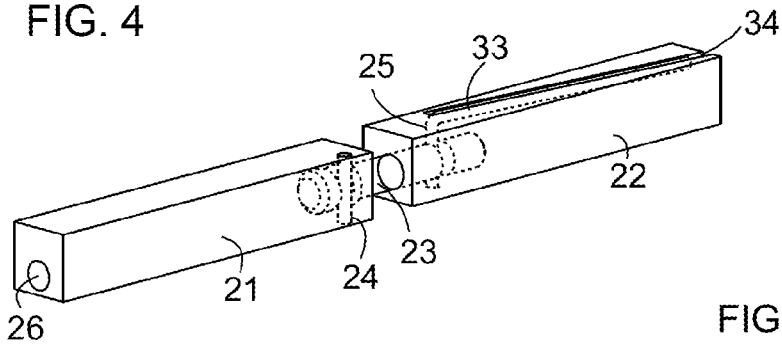

In the following, the invention is described in more detail by reference to the enclosed drawings, where FIG. 1 illustrates an example of a prior art divided spindle, FIG. 2 illustrates an example of a divided spindle according to the invention with the parts separated, FIG. 3 illustrates an example of a divided spindle according to the invention when assembled, and FIG. 4 illustrates an alternative form of connecting pin.

DESCRIPTION OF THE INVENTION

FIG. 2 illustrates an example of a divided spindle according to the invention with the parts separated. The divided spindle comprises a first spindle part 21, a second spindle part 22 and a connecting pin 23 connecting the spindle parts. Both spindle parts comprise a bore 27, 28 for the connecting pin 23. The connecting pin 23 is round in cross-section, and there are grooves 31, 32 close to both of its ends in transverse direction to the shaft of the connecting pin, going around the surface of the pin. Both spindle parts 21, 22 have a mounting hole 29, 30 transverse to the spindle shaft, touching the bore 28, 27 for the connecting pin.

The divided spindle also comprises cotters 24, 25 specific to each spindle part that can be fitted to the mounting holes 29, 30. The cotters can be used to connect the spindle parts to the connecting pin in a rotating fashion when the connecting pin is fitted to the bores 28, 27 in the spindle parts and the cotters are fitted to the mounting holes 29, 30 so that the cotters pecific to the spindle part settles into the transverse groove close to the end of the connecting pin. FIG. 3 illustrates an example in which the divided spindle is assembled.

In order to make it possible to install the spindle into the lock body without separate tools, it is recommended that at least one of the cotters 25 comprises an installation rod 33 transverse to the shaft of the cotter, and that at least one of the spindle parts 21, 22 comprises a groove 34 on its surface that is connected to the mounting hole 30. The installation rod of the cotter is mountable to the groove 34 on the surface of the spindle part so that the cotter 25 is in the spindle part's mounting hole. The groove 24 on the surface of the spindle part can be oblique or parallel to the longitudinal axis of the spindle part.

The cross-section of the cotter 24, 25 is preferably round. A round shape is preferable in terms of manufacturing and the shape of the mounting hole 29, 30. The round shape is also preferable in order to minimise the friction between the cotter 24, and the transverse groove in the connecting pin 23 and to simultaneously promote rotation of the spindle part in relation to the connecting pin 23 with the lowest possible friction. An embodiment of the invention can naturally also be implemented with cotters having some other cross-sections.

As shown in FIG. 4, the connecting pin 23 can be symmetrical in the longitudinal direction in relation to its midpoint. In this case, the bores 28, 27 in the spindle parts have equal diameters and the connecting pin is mountable either way in relation to the spindle parts. The connecting pin can also be asymmetrical, for example so that one end of the connecting pin is thicker than the other. In this case, the diameter of the bore in the spindle part also differs from the diameter of the bore in the other spindle part. FIGS. 2 and 3 illustrate such a connecting pin.

At least one of the spindle parts 21, 22 may comprise a third bore 26 for attaching a handle. The bore makes it possible to attach a handle to the spindle part of the divided spindle either directly to the spindle using a screw or to the lock cover plate using bearings and a locking ring, for example.

The cross-section of the transverse groove 31, 32 in the connecting pin can be a rectangle or a segment, for example. The ends of the connecting pin 23 can also be bevelled as illustrated in the embodiments of FIGS. 2 and 3. It is also possible that at least one of the ends of the spindle part 21, 22 is bevelled.

The divided spindle of FIGS. 2 and 3 can be installed in a door either way round. For example, the first spindle part 21 can serve as the inside spindle, while the second spindle part 22 serves as the outside spindle. When one of the cotters 25 has an installation rod 33, the installer does not need any separate tools to fit the cotter into the mounting hole 30. In accordance with the example of FIGS. 2 and 3, the assembled inside spindle 21 can be pushed through the spindle hole in the lock, after which the outside spindle part 22 can be pushed to the connecting pin and the cotter 25 can be pressed into place using the installation rod 33. The outside handle locks the installation rod to the groove 34 on the surface of the outside spindle. If necessary, both of the cotters in the divided spindle can be fitted with installation rods. A divided spindle delivered with an installation rod is easy to install.

A divided spindle according to the invention is mountable in a solenoid lock or a mechanical lock implementing a corresponding function as illustrated in FIG. 1. If a force 12 particularly in the longitudinal direction of the spindle is applied to the outside spindle part 22, the rotation between the connecting pin and the spindle part, as well as the small contact area, prevent unwanted transmission of force to the follower 9. The described examples also account for unwanted transmission of force to the follower due to a lateral force being applied to the spindle part.

It is preferred that the divided spindle according to the invention be constructed so that when an attempt is made to open the lock by force, the handle will break first, followed by the spindle and finally the lock.

The spindle structure according to the invention can be used to achieve a durable structure that is easy to manufacture. The structure is strong and secure against break-in, fulfilling the requirements of several burglary and vandalism tests.

It is evident from the examples presented above that an embodiment of the invention can be created using a variety of different solutions. It is also evident that the invention is not limited to the examples mentioned in this text but can be implemented in many other different embodiments within the scope of the inventive idea.

The invention claimed is:

1. A divided spindle of a lock comprising a first spindle part, a second spindle part and a connecting pin interconnecting the spindle parts, both parts comprising a bore for the connecting pin, the connecting pin being round in cross-section, wherein there are grooves close to both of the ends of the connecting pin in transverse direction to the shaft of the connecting pin, going around the surface of the pin, and both spindle parts have a mounting hole transverse to the spindle shaft, touching the bore for the connecting pin, and the divided spindle comprises cotters specific to each spindle part that are mountable to the mounting holes and that connect the spindle parts to the connecting pin in a rotating fashion when the connecting pin is mounted to the holes in the spindle parts and the cotters are mounted to the mounting holes so that the cotter specific to the spindle part settles into the transverse groove close to the end of the connecting pin, at least one of the cotters comprises an installation rod transverse to a shaft of the cotter, and at least one of the spindle parts comprises a groove on its surface that extends along a major part of the length of the spindle part and is connected to the mounting hole, while the installation rod of the cotter is mountable to the groove on the surface of the spindle part so that the cotter is in the spindle part's mounting hole.

2. A spindle according to claim 1, wherein the groove on the surface of the spindle part is oblique or parallel to a longitudinal axis of the spindle part.

3. A spindle according to claim 1, wherein the cross-section of the cotter is round.

4. A spindle according to claim 1, wherein the connecting pin is symmetrical in the longitudinal direction in relation to its midpoint.

5. A spindle according to claim 1, wherein the connecting pin is asymmetrical in the longitudinal direction in relation to its midpoint.

6. A spindle according to claim 1, wherein the cross-section of the transverse groove in the connecting pin is a rectangle or a segment.

7. A spindle according to claim 1, wherein at least one of the spindle parts comprises a third bore for attaching a handle.

8. A spindle according to claim 1, wherein the ends of the connecting pin are bevelled.

9. A divided spindle for a lock, the divided spindle comprising:

first and second spindle parts each formed with a bore extending longitudinally of the spindle part and with a mounting hole extending transversely of the spindle part and touching the bore of the spindle part, a connecting pin having first and second end regions to be received by the bores of the first and second spindle parts respectively, for interconnecting the spindle parts, the first and second end regions of the connecting pin being formed with first and second circumferential grooves respectively, and first and second cotters specific to the first and second spindle parts respectively, for mounting in the mounting holes of the first and second spindle parts respectively when the first and second end regions of the connecting pin are received in the bores of the first and second spindle parts respectively, whereby the first and second cotters settle in the first and second circumferential grooves respectively and each spindle part is connected to the connecting pin in a manner allowing relative rotation of the spindle part and the connecting pin, and wherein at least one of the cotters comprises a shaft portion for mounting in the mounting hole of the respective spindle part and an installation rod transverse to the shaft, and said respective spindle part is formed with a groove at its surface connected to the mounting hole, said groove extending along a major part of the length of said respective spindle part, whereby the installation rod can be received in the groove when the cotter is mounted in the mounting hole.

10. A divided spindle for a lock, the divided spindle comprising:

first and second spindle parts each formed with a bore extending longitudinally of the spindle part and with a mounting hole extending transversely of the spindle part and touching the bore of the spindle part, a connecting pin having first and second end regions to be received by the bores of the first and second spindle parts respectively, for interconnecting the spindle parts, the first and second end regions of the connecting pin being formed with first and second circumferential grooves respectively, and first and second cotters specific to the first and second spindle parts respectively, for mounting in the mounting holes of the first and second spindle parts respectively when the first and second end regions of the connecting pin are received in the bores of the first and second spindle parts respectively, whereby the first and second cotters settle in the first and second circumferential grooves respectively and each spindle part is connected to the connecting pin in a manner allowing relative rotation of the spindle part and the connecting pin, and wherein at least the first cotter comprises a shaft portion for mounting in the mounting hole of the first spindle part and an installation rod transverse to the shaft, and said first spindle part is formed with a groove at its surface connected to the mounting hole, said groove extending along a major part of the length of said first spindle part, whereby the installation rod can be received in the groove when the cotter is mounted in the mounting hole.

11. A spindle according to claim 10, wherein the shaft portion of the first cotter is circular in cross-section and the groove at the surface of the first spindle part is oblique to a longitudinal axis of the first spindle part.

12. A spindle according to claim 9, wherein said shaft portion is circular in cross-section and the groove at the surface of said respective spindle part is oblique to a longitudinal axis of said respective spindle part.

* * * * *